US005289674A

United States Patent [19]

Badiali et al.

[11] Patent Number: 5,289,674

[45] Date of Patent: Mar. 1, 1994

[54] WINDING MACHINE WITH AN IN-LINE PACKAGE PREPARER, AND AN IMPROVED SPINNING-WINDING METHOD

[75] Inventors: Roberto Badiali, Pordenone; Amedeo Quaia, Porcia; Luciano Bertoli, Pordenone, all of Italy

[73] Assignee: Savio, Pordenone, Italy

[21] Appl. No.: 990,949

[22] Filed: Dec. 14, 1992

Related U.S. Application Data

[63] Continuation of Ser. No. 719,780, Jun. 24, 1991, abandoned.

[30] Foreign Application Priority Data

Jun. 29, 1990 [IT] Italy ..... 20812 A/90

[51] Int. Cl.[5] ..... D01H 9/10; B65H 54/00

[52] U.S. Cl. ..... 57/281; 57/90; 242/35.5 R; 242/35.6 E

[58] Field of Search ..... 57/281, 90; 242/35.5 A, 242/35.5 R, 35.6 E

[56] References Cited

U.S. PATENT DOCUMENTS

| | | | |
|---|---|---|---|
| 3,224,694 | 12/1965 | Oishi | 242/35.5 A |
| 3,474,975 | 10/1969 | Boruwer et al. | 242/35.5 |
| 3,480,216 | 11/1969 | Iannucci et al. | 242/35.6 R |
| 3,544,018 | 12/1970 | Stoppard et al. | 242/35.6 R |
| 3,727,852 | 4/1973 | Nelson et al. | 242/35.6 R |
| 3,941,323 | 3/1976 | D'Agnolo et al. | 242/18 R |
| 4,432,198 | 2/1984 | D'Agnolo | 57/276 |
| 4,571,931 | 2/1986 | Kuepper | 57/281 |
| 4,576,340 | 3/1986 | Aretz et al. | 242/35.6 E X |
| 4,589,602 | 5/1986 | Reiners et al. | 242/35.5 R |
| 4,730,450 | 3/1988 | Tone | 57/281 |
| 4,848,688 | 7/1989 | Kubota | 242/35.5 R X |
| 4,858,836 | 8/1989 | Tone et al. | 242/35.5 R |
| 4,871,072 | 10/1989 | Colli | 209/656 |
| 4,896,841 | 1/1990 | Topuett | 242/35.6 E |
| 5,037,036 | 8/1991 | Okuyama | 242/35.6 E |
| 5,083,715 | 1/1992 | Wirtz et al. | 242/35.6 E X |

FOREIGN PATENT DOCUMENTS

| | | |
|---|---|---|
| 0290063 | 11/1988 | European Pat. Off. . |
| 3235442 | 5/1985 | Fed. Rep. of Germany . |
| 3742348 | 6/1988 | Fed. Rep. of Germany . |

*Primary Examiner*—John M. Jillions
*Assistant Examiner*—William Stryjewski
*Attorney, Agent, or Firm*—George P. Hoare, Jr., Shea and Gould

[57] ABSTRACT

A winding machine and method of operating the same in which prearranged packages of yarn are formed during spinning by inserting the yarn end through the upper cavity of a yarn tube by a package arranging device and the prearranged packages are conveyed in a vertical or substantially vertical position to a package carrier wherein the package carrier is maintained fully loaded with the prearranged packages.

2 Claims, 5 Drawing Sheets

FIG. 2A1

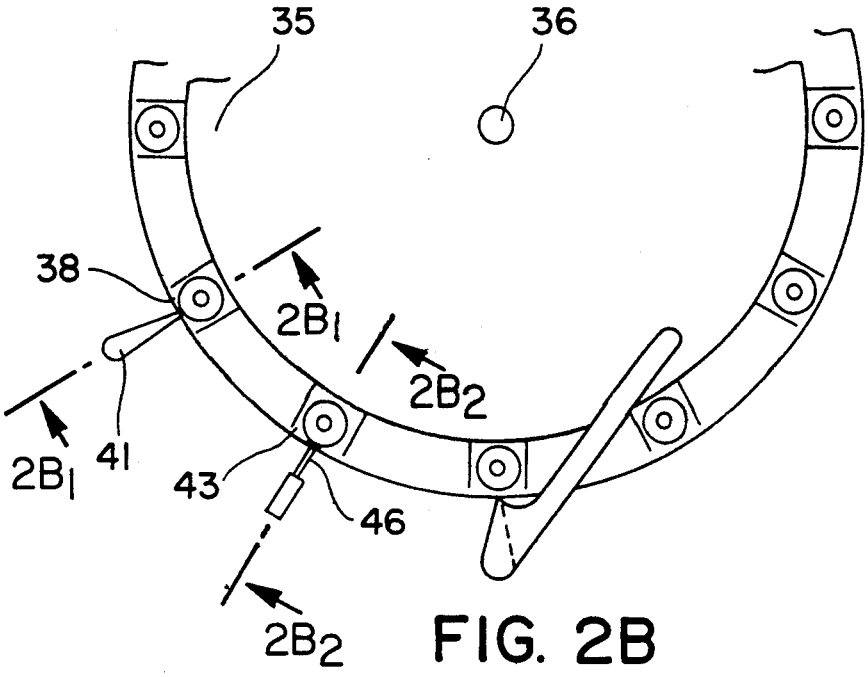
FIG. 2B
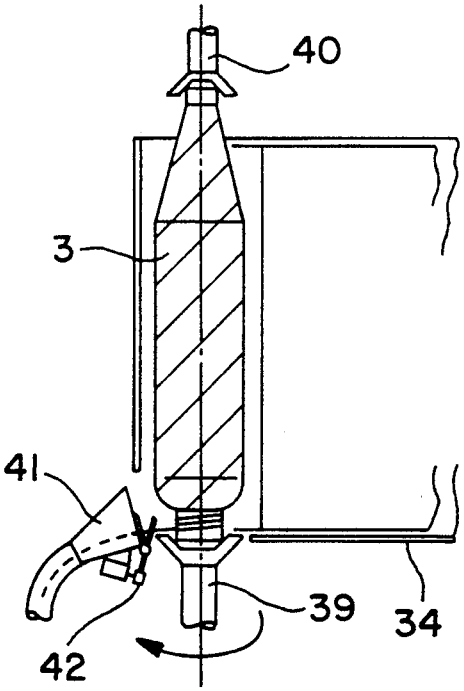
FIG. 2B1
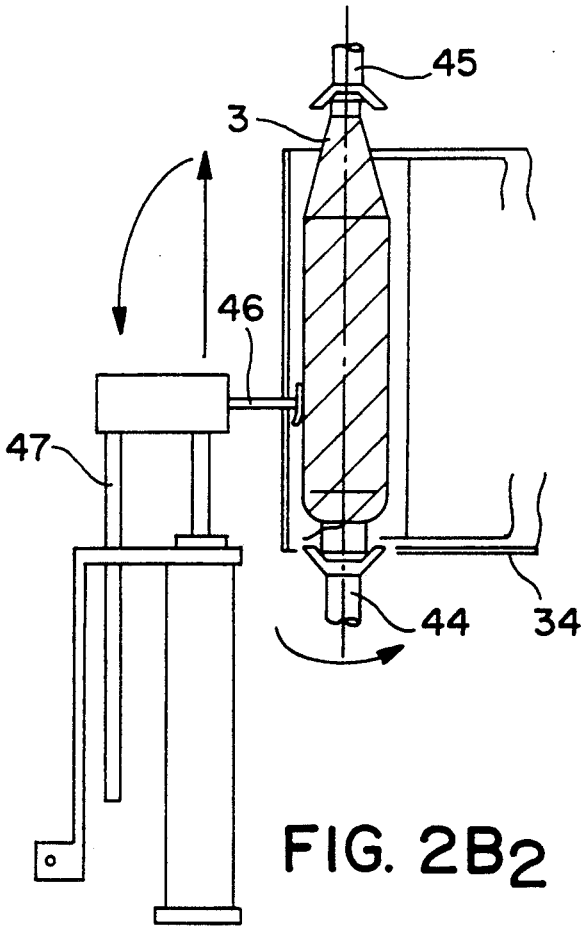
FIG. 2B2

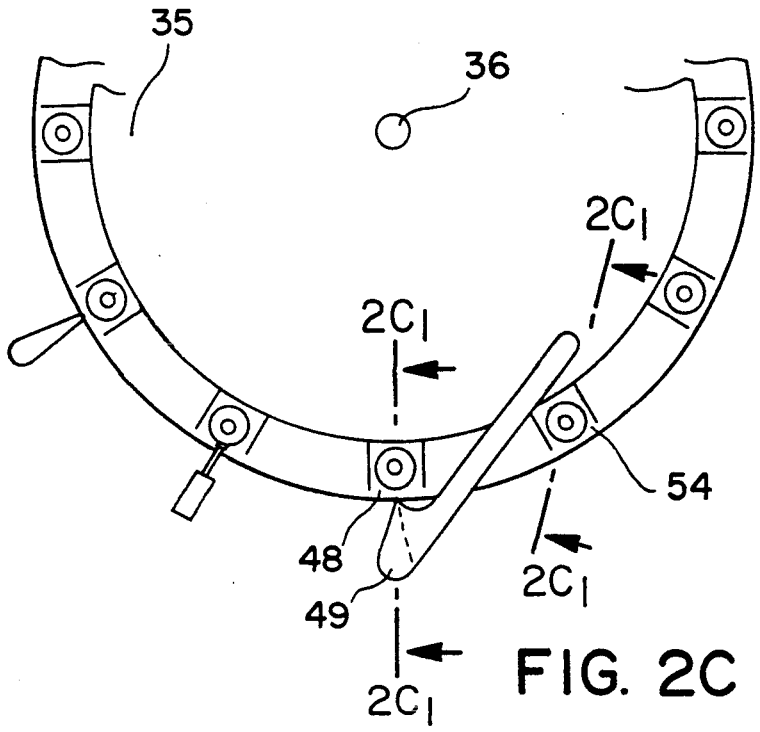
FIG. 2C
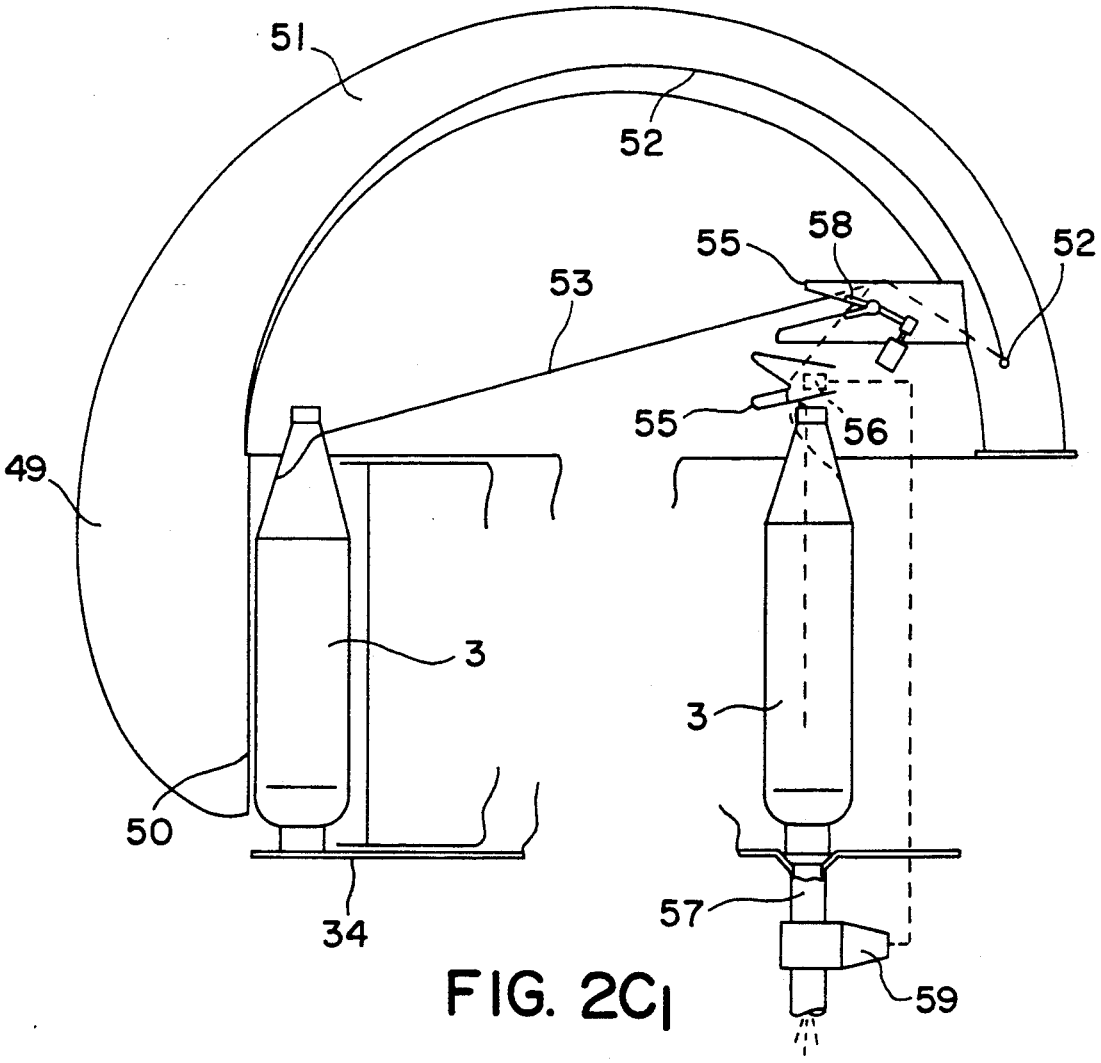
FIG. 2C1

WINDING MACHINE WITH AN IN-LINE PACKAGE PREPARER, AND AN IMPROVED SPINNING-WINDING METHOD

This is a continuation of application Ser. No. 07/719,780, filed Jun. 24, 1991, now abandoned.

FIELD OF THE INVENTION

This invention relates to high-quality yarn production by the integrated spinning and winding process, in which the yarn is produced in the first stage generally in a ring spinning machine, whereas in the second stage the produced yarn is rewound to remove or at least considerably reduce its defective portions in order to obtain a product which is of good quality both in terms of its appearance and in terms of its mechanical strength.

BACKGROUND OF THE INVENTION

The winding process is much faster than the spinning process and therefore a small number of winding stations is able to wind or rewind the yarn produced in a much higher number of spinning stations. This results in the production of a large number of wound yarn packages which are then combined into a smaller number of larger-size bobbins which represent the final product of the spinning-winding machine. For the winding stage the packages produced in the spinning station must be presented to the winding stations with a yarn end in a predetermined position, this being generally a vertical position with the yarn end inserted through the upper aperture of the tube which forms the core of the package.

The winding machine is thus able to automatically grasp the yarn end and commence its rewinding to form the bobbin.

Currently available spinning-winding machines are characterised by a large number of spinning stations of up to one thousand or more, but only a small number of winding stations of the order of some tens, between which the empty tubes recycled from the winding machine for receiving the new wound packages and the yarn-wound packages to be rewound are conveyed. In order to reduce the work load this conveying together with the prearranging of the packages is handled in recently designed spinning-winding machines by automatic conveyor devices of various designs which limit the work of the operators to mere supervision and intervention in the case of possible machine malfunction.

The winding stage generally has a higher capacity than the spinning stage to allow the winding machine to handle the yarn production without any build-up during its operation. The problem of conveying the packages and tubes was dealt with up to a few years ago by interposing truck-mounted bins between the two stages to randomly receive the full packages or empty tubes, and from which they were withdrawn by loading and arranging devices or more simply by the operators themselves.

The winding machine discharges not only tubes completely empty of yarn for recycling to the spinning machine, but also a small but not negligible number of tubes not completely empty of yarn, from which the automatic winding machine is unable to take up further yarn because the end is no longer recoverable by the devices with which each station is equipped.

These irregular packages from which part of the yarn cannot be unwound arise because of imperfect package winding during the spinning operation, resulting in successive yarn turns becoming engaged under slack turns which have been previously wound. So that when these turns are unwound in the winding machine they become blocked with the result that the yarn breaks at a point prior to the path through which the yarn is under the control of the winding members, and along which yarn continuity can be automatically restored by splicing.

These tubes have to be selected, recovered and fed to the package arranging device in order to use up the yarn still wound on them by finding its end and then refeeding them to the winding machine.

The known art comprises a large number of spinning-winding machine arrangements.

According to German patent No. 3235442 of Murata Kikai, the packages and tubes are conveyed between the spinning and winding machines with the aid of disc supports provided with a tube engagement peg, the discs being placed on conveyor belts.

U.S. Pat. No. 3,941,323 of Savio describes a device for preparing wound packages for rewinding, including searching for, preparing and retaining the yarn end. U.S. Pat. No. 4,432,198 of the same proprietor describes a device for conveying packages between the two stages.

U.S. Pat. No. 4,571,931 of Schlafhorst describes a transfer device between the spinning and winding machines which acts as a buffer store between the two machines and feeds the packages to the winding machine when requested by the winding stations. This device also allows for prearranging of the packages. The proposed methods include a large variety of conveyor systems, namely smooth conveyor belts on which the packages are either laid on their sides or supported by said discs, conveyor belts provided with fixed vertical pegs for engaging the tubes and packages in a vertical position, sector elevators and conveyors, and gripper devices, generally combined with each other.

SUMMARY OF THE INVENTION

The present invention comprises a spinning-winding machine in which the two stages are connected together by a conveyor device serving the spinning machine. There is also included an interposed in-line device for package preparation which itself feeds a conveyor which serves the winding machine and acts as the winding machine feeder and buffer, thereby making the feed to the winding stations time-independent of the feed of packages from the spinning machine and of the package prearranging operation. The spinning-winding machine according to the invention is also provided with means for handling those packages which have not been completely emptied or are otherwise irregular so that they do not accumulate within the cycle and occupy working positions, thus enabling yarn to be recovered to a maximum extent from irregular packages but without reducing the overall productivity of the spinning-winding machine.

BRIEF DESCRIPTION OF THE DRAWINGS

The spinning-winding machine according to the invention is described with reference to a typical embodiment shown in FIGS. 1 to 4 by way of non-limiting example.

FIG. 1 is an overall view of the spinning-winding machine according to the invention;

Figure 2A:
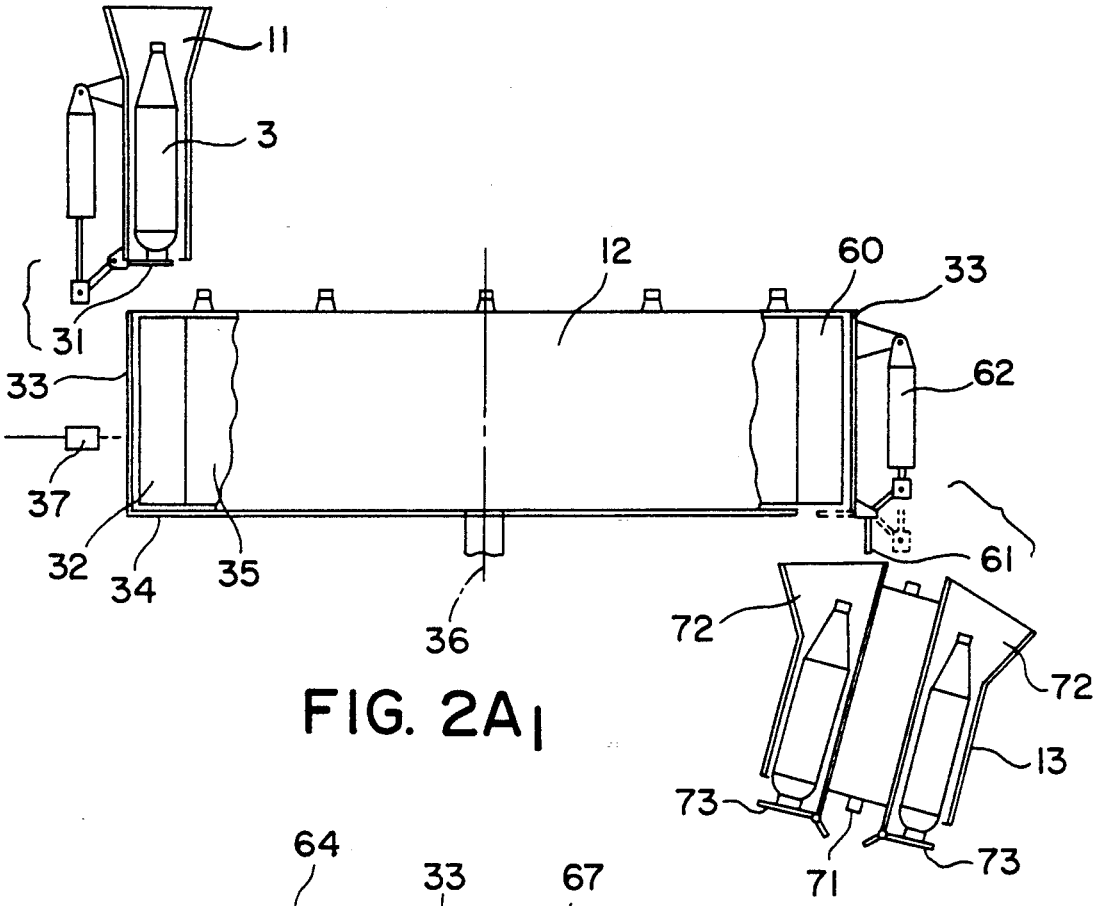
FIG. 2A is a plan view of the machine for preparing a package for subsequent rewinding in accordance with the embodiment of FIGS. 1A and 1B.
Figure 3A:
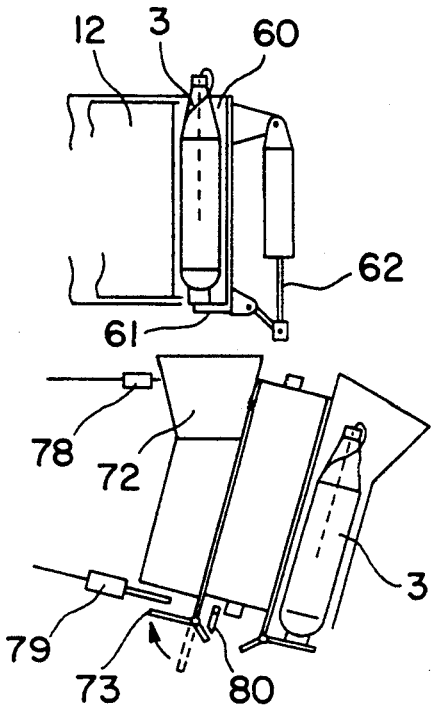
Figure 3B:
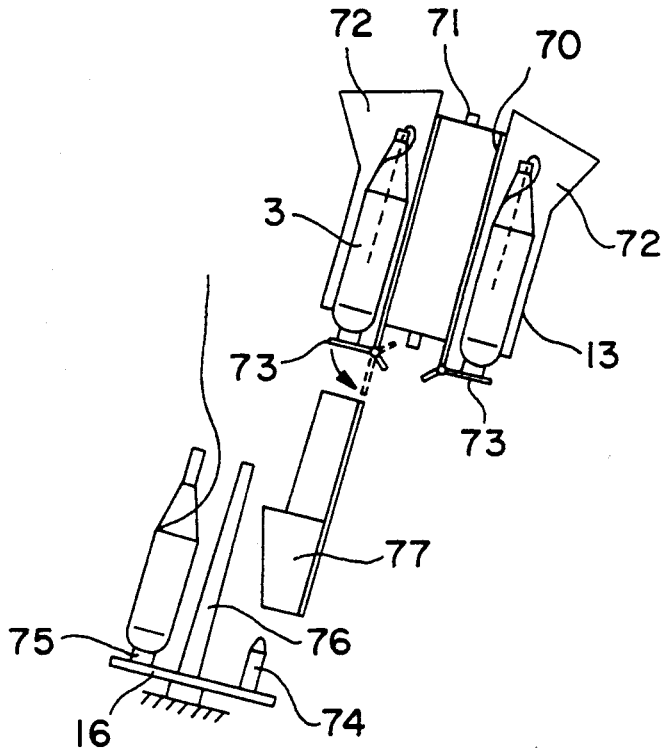
Figure 4:
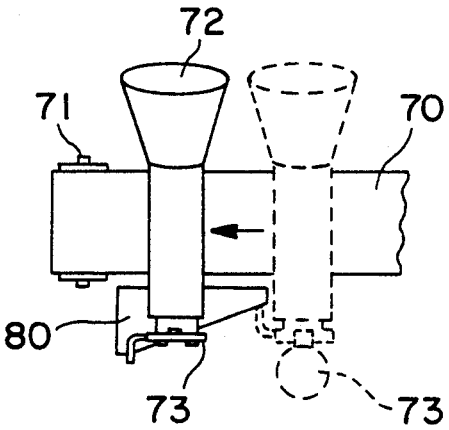

FIG. $2A_1$ is a side view of the machine illustrated in FIG. 2A;

FIG. 2B is a plan view of the first and the second stations of the machine for preparing packages;

FIG. $2B_1$ is a side view of the first and the second stations taken along section lines A—A of FIG. 2B;

FIG. $2B_2$ is a side view of the second station taken along section lines B—B of FIG. 2B;

FIG. 2C is a plan view of the third station of the machine for preparing packages;

FIG. $2C_1$ is a side view of the third station taken along section lines C—C of FIG. 2C;

FIG. 3A is a side view of the pocket container employed in the present invention;

FIG. 3B is a side view of the package carrier of the present invention;

FIG. 4 is another side view of the pocket container of the present invention.

DETAILED DESCRIPTION OF THE INVENTION

The spinning machine 1 includes a plurality of ring spinning stations 2, in which the feed sliver is worked to produce yarn which is collected in the form of packages 3 located in the bottom of the unit.

The spinning stations 2 can be disposed on one or both faces of the spinning machine to form spinning faces. Each spinning face is provided with devices 4 for doffing the complete packages and replacing them with empty tubes on which the yarn is then wound to form new packages, and a device 5 for conveying said packages and said empty tubes. According to a preferred embodiment the conveying device 5 is a belt conveyor driven with stepwise movement and provided with pegs 6 designed to hold in a vertical position the packages to be unloaded from the spinning machine and the empty tubes to be loaded onto it. The even numbered pegs are intended to receive the product packages and the odd numbered pegs are intended to receive the empty tubes or vice versa.

The doffing operation comprises the following procedure. When the spinning section has completed the packages to the desired wound length and these are to be doffed and replaced with empty tubes, the doffing device 4 rises and moves its gripper members 7 over the top of the packages 3, represented by the top of the tube, and withdraws them by raising said packages from the spinning machine, moving them outwards and then lowering them onto the even numbered pegs 6 of the conveyor 5. European patent application No. 88200602 of the present applicant describes gripper members for the doffing operations within a spinning machine.

The gripper members 7 are then released to leave the packages on the even pegs, and the doffing device is then raised through a small distance. The conveyor 5 is advanced through one step so that its gripper members are now in a position corresponding with the empty tubes disposed on the odd pegs. The device 4 is relowered to make contact with the top of the empty tubes and its gripper members 7 again made to operate on the empty tubes. The device 4 then undergoes the reverse movement to that previously described, to mount the empty tubes in place of the complete packages which have just been unloaded from the spinning units. At the commencement of the doffing operation the odd pegs are occupied by the empty tubes to be supplied to the spinning machine, and on termination of the operation the even pegs are occupied by the complete packages to be fed to the winding machine.

Said packages are conveyed by advancing the conveyor 5 stepwise towards the transferring unit 9 which, in a preferred but not exclusive embodiment, comprises a stepping conveyor provided with gripper members 10 and having a portal configuration, which enables equipment and persons to pass between the spinning and winding machines.

Figure 1A:
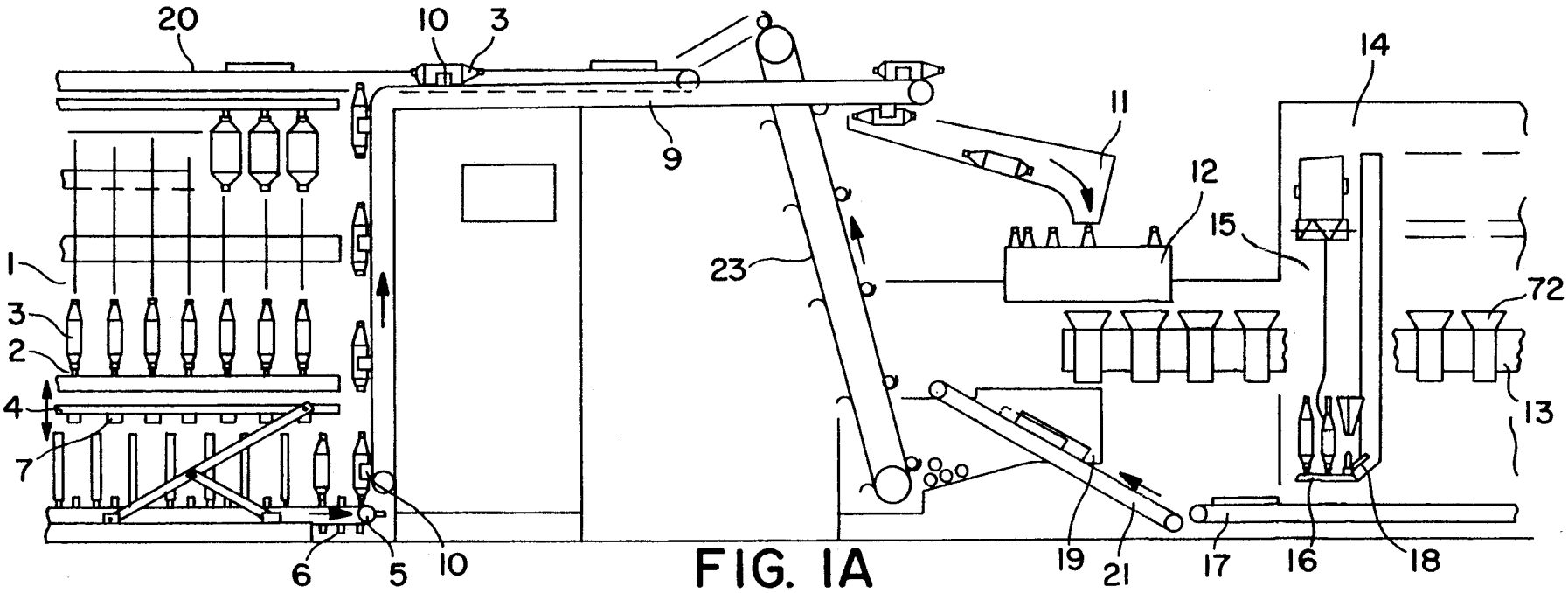
FIG. 1A is a side view of the spinning-winding mechanism of the present invention.
Figure 1B:
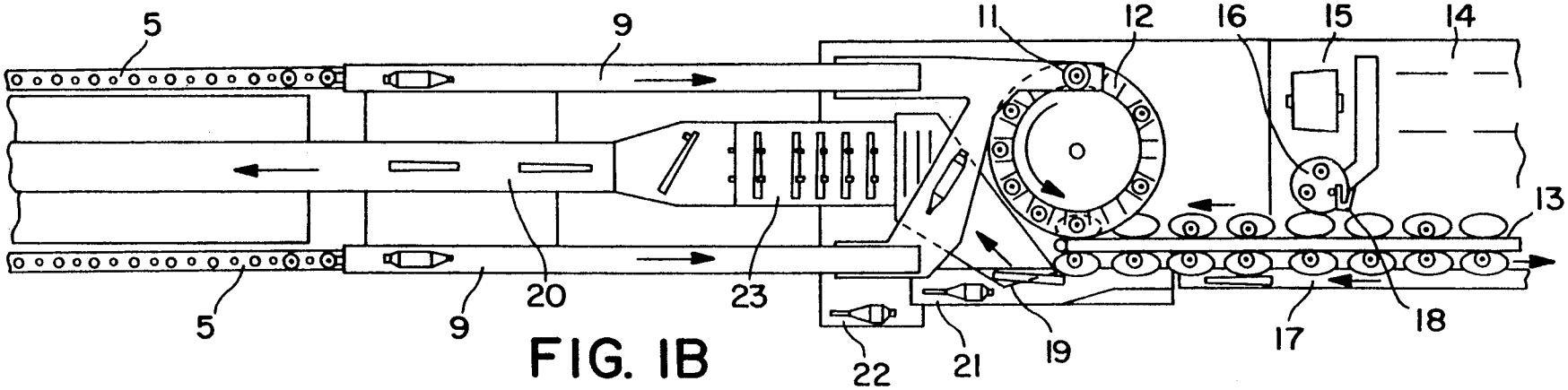
FIG. 1B is a plan view of the machine illustrated in FIG. 1A.

According to the embodiment shown in FIG. 1 by way of example, the grippers 10 grip the middle of the packages 3.

The conveyor 5 and transferring unit 9 move synchronously so that each new package 3 presented by the conveyor 5 is received by an open gripper 10 which is ready to close. When the package has been withdrawn by the grippers 10 of the transferring unit 9, and the transferring unit has advanced through one step to present a new gripper 10, the conveyor 5 is able to undergo a new advancement step to present a new package. The control sensors used can be mechanical feelers, photoelectric cells or equivalent sensing devices.

If the spinning machine 1 is constructed with two spinning faces and two conveyors 5, there will also be two transferring units provided. The transferring unit or units 9 discharge the packages 3 into a positioning funnel 11 which feeds the device 12 for prearranging the packages for their feed to the winding machine. If there are two transferring units 9 and both the spinning faces have packages to be conveyed, the package conveying procedure can be implemented by firstly entirely discharging one spinning face and then the other or by alternately presenting packages from both conveyors 5 so that the positioning funnel 11 alternately receives packages from both faces one at a time.

In order to shorten conveying times, for the first method of operation the conveyor can be operated with double steps, whereas for the second method the two conveyors can be operated with single instead of double steps and staggering between the two faces the positions occupied by the complete packages and empty tubes.

Before the next doffing operation, other empty tubes are loaded onto the conveyor 5 in their assigned even or odd position. The spinning and winding operations can be conducted independently by arranging a buffer store of packages between the two machines and supplying the feed funnel 11 of the device 12 from this store. The package prearranging device 12 represents one of the most characteristic parts of the present invention and is described hereinafter in greater detail with reference to FIG. 2. Its purpose is to prearrange the packages so that their yarn end is intact and free, and inserted by a predetermined length through the upper aperture of the tube which acts as the core of the package 3 fed to the winding machine. In this respect the winding machine is provided with means for taking up the yarn from this position and automatically commencing its rewinding. The device 12 feeds the package carrier 13 which serves the winding machine 14.

The package carrier 13 comprises a conveyor in the form of a horizontally moving chain or belt carrying a series of preferably vertical or substantially vertical cylindrical pockets which receive the prearranged packages from the device 12 and convey them to all the constituent winding units 15 of the winding machine 14. The package carrier 13 is also one of the most characteristic parts of the present invention and is described hereinafter with reference to FIG. 3 which shows it in greater detail. Each winding station 15 is provided with a multi-position loading support 16 (in FIG. 3 three positions are shown by way of example, namely one for the package being wound, one for a reserve package and one for the tube to be discharged) in which the packages to be unwound during winding are placed and from which the empty tubes are removed to be recycled upstream by a conveyor 17. The loader 16 is in the form of a rotatable support provided with slightly tapering pegs for centering the packages and tubes placed on them and for holding them in an approximately vertical position, and is driven with stepwise rotation to move into the working state the position already provided with a package to be unwound, so that as soon as one package is empty another can be immediately worked without having to wait for the time required for reloading a new package fed by the package carrier 13.

The empty tubes and defective packages are expelled by a mechanism 18, comprising, for example a cam-controlled rod which removes the tubes from their pegs to discharge them onto the tube recycle conveyor 17. Within the path of this conveyor there is inserted a selector 19 for selecting empty tubes and packages still containing a residual yarn winding. The selection can be made for example by the device in accordance with U.S. Pat. No. 4,871,072 of SAVIO S.p.A.

The empty tubes are recycled to the spinning machine by the conveyor 20 whereas the packages containing a residual winding are conveyed to the collection bin 22 by the conveyor belt 21. If completely empty, the tubes recycled to the spinning machine are fed to the vertical belt 23 which conveys them to the loading station for the spinning machine conveyor 5, whereas if they contain wound yarn residues they are discarded to be cleaned separately.

Figure 2A:
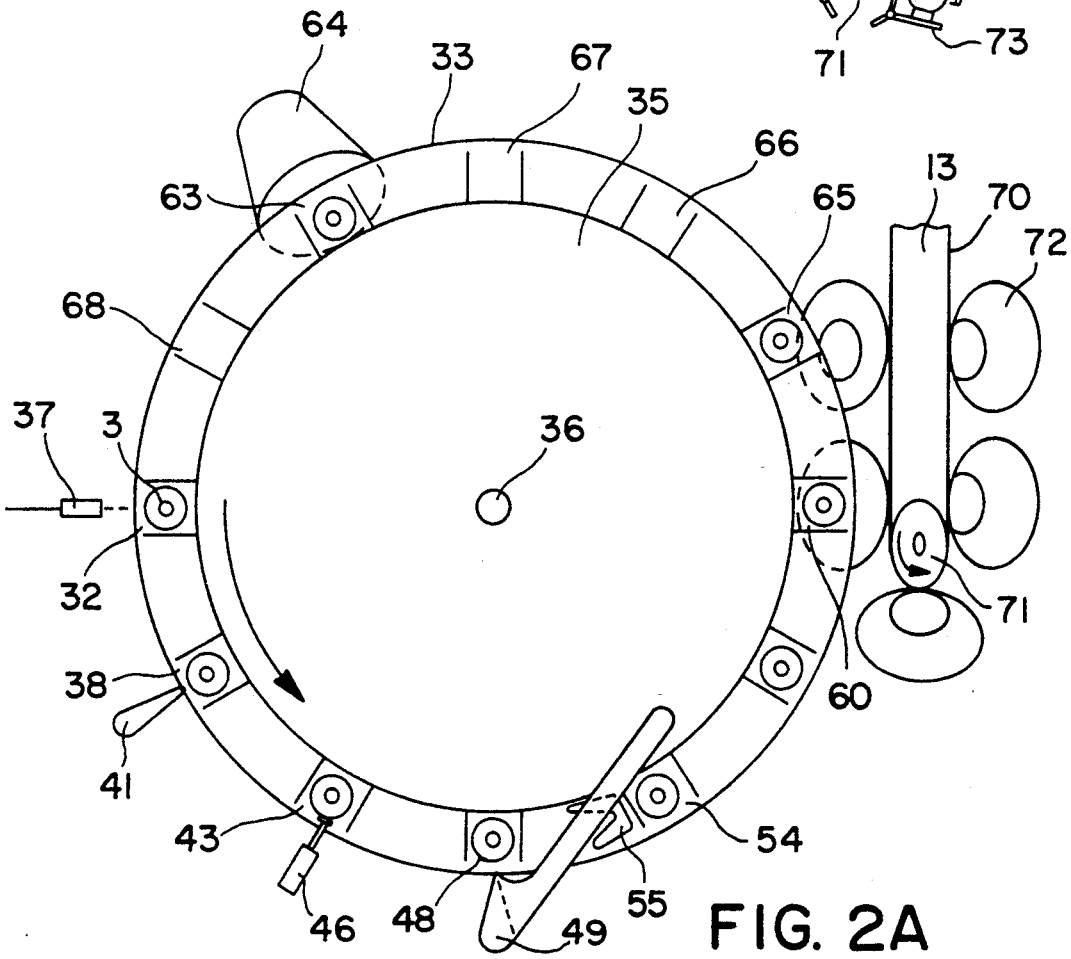

FIG. 2 shows the device 12 for preparing the package in order to prearrange it for its subsequent rewinding.

The funnel 11 contains the package 3 originating from the spinning stage either directly via the transferring unit 9 or from a further conveyor which withdraws it from a buffer package store if the spinning and winding stages are not directly connected. The door 31 allows the package 3 to fall into the underlying compartment 32 after a control sensor has provided a signal to the effect that this compartment is free of packages. In this respect, the device 12 comprises a fixed cylindrical tank comprising a circular wall 33 and a flat bottom 34, and within which a drum 35 rotates about the axis 36.

The drum 35 is provided with a series of compartments which rotate with it to carry the packages into a plurality of stations in which the preparation stages are carried out.

In the position occupied by the compartment 32, sensor means 37 such as photoelectric cells or mechanical sensors check whether the compartment is occupied by a package. If the compartment is free the sensors cause a new package to be loaded from the overlying funnel 11, whereas if the compartment is occupied they provide the enabling signal for the forward rotation of the compartment.

The drum therefore rotates to move the said compartment into position 38 in which the first preparation stage takes place, in accordance with FIG. 2A.

In the station 38 there is a live centre with a conical cavity 39 driven by a motor not shown in the figure, and against which the package is pressed and centered by an axially mobile idle centre 40.

When the package 3 is locked between the live centre 39 and idle centre 40 the live centre 39 is rotated to unwind the yarn wound on the lower end of the package 3, as normally it has to be. During the spinning stage, as the packages are produced the last yarn turns are wound on the lower end of the tube and the package is then freed by tearing the yarn during the doffing operation. By the effect of both the counter-rotation and the suction provided by the nozzle 41 disposed in the bottom of the compartment, the yarn end is taken in by the nozzle 41 and cut with the scissors 42. That portion of yarn which may have been damaged at the end of spinning or during doffing is thus removed. The yarn end is now parallel to the package axis.

The drum now moves to the second station, which provides a further search for an extending yarn end in case the first operation had been unsuccessful, for example because the yarn end had not been correctly wound on the tube base.

In the second station 43 (FIG. 2B) there are a rotating live centre 44 with a conical cavity and an idle centre 45 which moves axially to centre and lock the package 3. These are similar to those of the first station but are rotated in the direction of the package winding, to thus wind the yarn.

When the live centre 44 and idle centre 45 have been moved towards each other to lock the package 3, this is rotated while a claw-shaped implement 46 is slid slowly downwards in contact with the surface of the package, which as it rotates applies the yarn to the claw, so unravelling the package yarn end, releasing it and making it parallel to the package axis. The claw-shaped implement 46 is slightly pressed against the package and moved slowly downwards along the guide 47 parallel to the tube axis. The package rotates in the direction of the winding, causing the yarn turn to surmount the claw 46 as the speed of advancement of the claw is less than the axial speed at which the wound yarn turn proceeds.

The drum then moves to the third preparation station 48 (FIG. 2C).

The suction nozzle 49, comprising a suction slit 50 and a curved body 51 extending as far as the suction manifold, is moved up to the package 3 and draws in the yarn end. The curved body 51 comprises a slit 52 along the interior of its curve so that yarn for which the yarn end has entered the manifold re-emerges to take the path 53.

The package 3 is then advanced to the fourth preparation station 54, while still leaving the yarn end captured in 53. The yarn moves into the position shown by the dashed line and enters the lead-in 55.

Said lead-in comprises a yarn presence sensor 56 which notifies when the yarn end has been received. In position 54 the package 3 rests with the base of its tube in a position corresponding with a suction nozzle 57 comprising a conical lead-in for its correct centering.

When enabled by the sensor 56, on sensing the presence of yarn in the V-shaped lead-in 55, a scissor cutter 58 disposed in proximity to said lead-in is operated to cut the yarn. The thus released yarn end is drawn into the interior of the package tube by the effect of the suction through the nozzle 57, which is activated by a solenoid valve 59 operated when the sensor 56 enables the cutting of the yarn end.

The package is now prearranged for use in the winding operation. The described yarn preparation procedure in terms of the searching for the yarn end is similar in its essential lines to that described in the cited U.S. Pat. No. 3,941,323.

The drum then advances into the fifth station 60, in which a drop 61 operated by a pneumatic piston 62 is provided and when enabled by the sensor 56 opens under the control of the underlying device 13. The package 3 prearranged for the rewinding of its yarn is thus transferred to the device 13.

If in contrast the sensor 56 does not give the enabling signal for the discharge of the package because it has not sensed yarn presence, the package is conveyed through the stations 54 and 60 without being discharged, and is moved beyond the path of the device 12.

The distance between the package 3 and the scissor cutter 58 must be such that a sufficient yarn end length is left for it to penetrate into the tube by a sufficient length, preferably by ⅔ of its length.

Any package which on the basis of the sensing operation by the sensor 56 has not been properly prepared is recirculated stepwise until it reaches the position of the compartment 32, to recommence the cycle.

This event is recorded in the machine control memory, and any compartment occupied by a recycled package is kept available for it for a further one or at the most two revolutions. After one or two repetitions of the operation, the occupied compartment is freed in a subsequent station, for example 63, provided with a drop similar to 61 which discharges the unprepared package into a discarded package box, not shown in the figure, via a lead-in 64.

The device 12 operates with the loading position 32 and its five preparation stations always occupied by packages and advances one step each time the subsequent device 13 requires a package from it because it has a free position to occupy. The device 12 therefore operates in line with the subsequent device 13.

The further available stations, for example from 65 to 68, are used for feeding packages not completely empty of yarn to undergo preparation for rewinding, and from which the yarn end must be recovered in order to be able to recycle them to the rewinding. FIG. 3 shows the package carrier 13.

The package carrier 13 comprises vertical or slightly off-vertical axis driven by pulleys rotated by a motor not shown in the figure, and carrying a series of flared pockets 72 having a bottom aperture 73 which can be opened on command when in a position corresponding with the loaders 16 which, as stated by way of example heretofore, comprise a free peg 74 to be loaded with a new package while the adjacent peg 75 is already provided with a package being unwound, and the peg 76 carries a tube to be discharged.

In correspondence with the peg in position 74 there is a chute-shaped lead-in 77 which guides the package onto said peg, which is offered to it.

The spinning-winding machine as heretofore described results in considerable yarn production advantages, as will be apparent from the description of the spinning-winding procedure.

According to the present invention the packages are conveyed in such a manner as to maintain the pockets 72 and at least one of the pegs of the loader 16 of each spinning station always filled with packages prearranged for winding. The winding procedure is therefore over a considerable period independent of the times required for the delivery of new packages by the spinning machine, and is not affected by any build-ups in the conveying between the two stages, which work on hundreds of full packages and empty tubes per hour of operation, so allowing such build-ups to be remedied without influencing the winding stage.

If the package loader 16 contains three or more pegs, the package can be changed in it by firstly removing the emptied tube and then replacing it with a new prearranged package, or vice versa. If the loader has only two positions the emptied tube must be firstly removed and then replaced with a new package. In both cases the other position carries the already present package into its working position without any delay.

The conveyor 13 is always kept moving. This movement can be slow and continuous, or can be stepwise.

The two methods are equivalent because of the flaring of the pockets 72 and the lead-in 77, allowing discharge during movement both from the swing door 61 and from the openable base 73. FIG. 4 shows the pocket container 72 in greater detail.

Each pocket container 72, fixed to the belt 70, is provided with a base 73 which can be opened by an electromechanical release device operated by the loaders 16 each time they rotate. When a rotation has taken place, an operating rod for the release device—of conventional type and therefore not shown in the figures—is extended so that it engages the first container 72 presented, so opening its base 73. This rod then retracts until it is again triggered.

As already described, the pocket 72 travels along its path normally provided with a package 3 which rests on the base 73. Detecting sensors are located along the path of the pocket 72 just prior to where it passes under the position in which the package is discharged from the position 60 of the package prearranging device 12.

The sensor 78, for example a magnetic sensor which detects the presence of a metal projection on the upper part of the pocket, indicates the presence of the pocket which is being moved into the position for receiving the package, and the sensor 79, for example a flexible rod, determines whether a package is already present or whether the pocket is empty.

If the sensor 78 detects the presence of the pocket and the sensor 79 detects that the pocket is empty, the discharge command is fed to the drop 61.

When the position 60 has been discharged, the device 12 is rotated through one step, so that package prearranging is resumed and another package is introduced in position 32.

Until position 60 is released of its prearranged package, the device 12 is kept at rest and cannot receive further packages. The pocket container 72, loaded with its package by 61, continually travels along the face of the winding machine 14 on the belt 70 until a loader 16 requests its package and causes the base 73 to open, so that the package 3 falls into the lead-in 77 and then onto the peg 74. The pocket 72 continues along its path in an open configuration until it encounters an inclined surface 80 which resets the base 73 by snap-closing it. This resetting member is located prior to the sensors 78 and 79, which themselves precede the position for loading by 12.

The package carrier 13 preferably has a number of pockets equal to a multiple of the number of winding stations, namely two or three times, to ensure a whole number of reserve packages. The remaining part of the conveying procedure is therefore in a direct line to the winding machine without the need for intermediate buffers. The conveying procedure operates such that the available positions of the package carrier 13 are always kept engaged, and its request for packages extends upstream as far as the doffing device, which is therefore dependent on it, leaving aside the intrinsic capacity of the intermediate conveyor members. In the device and method according to the invention, the operations involved in the prearranging and conveying of the packages are conducted with the packages always in a substantially vertical position, so obviating any need for handling to orientate them correctly for winding.

We claim:

1. A method of preparing packages, comprising:

(a) prearranging packages of yarn having a core, during spinning by inserting a yarn end through a yarn tube, wherein said prearranging step comprises rotating the yarn package in an opposite direction to the yarn windings and searching for the yarn end by a suction nozzle disposed in proximity to a base of the yarn tube, rotating the prearranged package in the direction of the yarn windings and traversing the package surface with a claw-shaped implement so that the yarn end is arranged parallel to the package axis, retaining the yarn end by a curved nozzle, cutting the yarn end to length and then drawing the cut yarn end into the tube which forms the core of the package;

(b) sensing whether the yarn end has been grasped or not grasped by a suction means during said prearranging step, and recycling the package for which the yarn end has not been grasped back to said prearranging step;

(c) conveying the prearranged packages to a package carrier at a winding station; and (d) fully loading the package carrier; wherein during said prearranging and conveying steps, the packages are maintained in a substantially vertical position.

2. A machine for preparing packages comprising:

(a) a yarn package prearranging device for prearranging packages of yarn produced in a preceding spinning step, said device comprising means for withdrawing the yarn end wound on the packages originating from the spinning step, means for rotating the yarn package in an opposite direction to the yarn windings, means for seeking the yarn end along the surface of the package by means of a claw-shaped implement traversing the package surface so that the yarn end is arranged parallel to the package axis, means for grasping the yarn end, means for determining whether or not the yarn end has been grasped, means for inserting the yarn end through the upper cavity of a tube which forms the core of the prearranged package and means for discharging those prearranged packages for which the yarn ends have been inserted through the upper cavity of the tube from the device; and (b) a package carrier for conveying the prearranged packages to a plurality of winding stations for unwinding the yarn to form yarn bobbins, said package carrier comprising a horizontally extending conveyor having substantially vertical pockets and adapted to continuously travel along the winding stations to deliver the prearranged packages.

* * * * *